US008919355B2

(12) United States Patent
Blanch

(10) Patent No.: US 8,919,355 B2
(45) Date of Patent: Dec. 30, 2014

(54) COSMETICS STORAGE DEVICE

(71) Applicant: Le Metier De Beaute, New York, NY (US)

(72) Inventor: Richard Blanch, Hopewell Junction, NY (US)

(73) Assignee: Metier Tribeca, LLC, New York, NY (US)

( * ) Notice: Subject to any disclaimer, the term of this patent is extended or adjusted under 35 U.S.C. 154(b) by 0 days.

(21) Appl. No.: 13/778,483

(22) Filed: Feb. 27, 2013

(65) Prior Publication Data

US 2014/0238434 A1 Aug. 28, 2014

(51) Int. Cl.

| | |
|---|---|
| ***A45D 33/22*** | (2006.01) |
| ***A45D 33/20*** | (2006.01) |
| ***A45D 27/22*** | (2006.01) |
| ***B65D 43/14*** | (2006.01) |
| ***A45D 42/00*** | (2006.01) |
| ***B65D 69/00*** | (2006.01) |
| ***B65D 71/00*** | (2006.01) |
| ***A45D 40/24*** | (2006.01) |
| ***A45D 40/22*** | (2006.01) |
| *A45D 33/00* | (2006.01) |

(52) U.S. Cl.

CPC ..... *A45D 40/24* (2013.01); *A45D 40/221* (2013.01); *A45D 33/008* (2013.01); *A45D 33/20* (2013.01); *Y10S 206/823* (2013.01)

USPC ..... 132/287; 132/295; 132/316; 206/581; 206/823; 206/235

(58) Field of Classification Search

USPC ..... 132/287, 75, 286, 291, 293–296, 298, 132/300, 301, 303, 305, 314–16; 206/581, 206/823, 235, 6.1, 499, 504, 507–509, 818, 206/821; 220/4.21–4.27, 476–479, 23.2, 220/23.6, 23.8, 821, 822, 825, 826, 283, 220/836, 837; 16/224, 225

See application file for complete search history.

(56) References Cited

U.S. PATENT DOCUMENTS

| | | | | | |
|---|---|---|---|---|---|
| 1,460,950 | A | * | 7/1923 | Denney | 132/295 |
| 1,463,259 | A | * | 7/1923 | Flagg | 132/295 |
| 1,549,276 | A | * | 8/1925 | Loesser | 132/295 |
| 2,035,832 | A | * | 3/1936 | Parkin | 132/300 |
| 3,188,157 | A | * | 6/1965 | Rand | 312/202 |
| 3,392,868 | A | * | 7/1968 | Pfrommer | 220/520 |
| 3,441,033 | A | * | 4/1969 | Flax | 132/295 |
| 3,476,123 | A | * | 11/1969 | Flax | 132/315 |
| 3,776,245 | A | * | 12/1973 | Hayes et al. | 132/304 |
| 4,165,815 | A | * | 8/1979 | Vetter | 220/4.27 |
| 4,807,773 | A | * | 2/1989 | Tsai | 220/4.27 |
| 4,815,483 | A | * | 3/1989 | DuGrenier et al. | 132/295 |
| 4,821,751 | A | * | 4/1989 | Chen | 132/295 |
| 4,944,402 | A | * | 7/1990 | Wu | 206/581 |
| 5,025,817 | A | * | 6/1991 | Wen | 132/296 |
| 5,246,020 | A | * | 9/1993 | Wu | 132/295 |

(Continued)

*Primary Examiner* — Vanitha Elgart

(74) *Attorney, Agent, or Firm* — Millen, White, Zelano & Branigan, P.C.

(57) ABSTRACT

A cosmetics storage device with a lid, drum assembly, and at least two drawers where the drawers are nested in the drum assembly and connected to each other and secured in the drum assembly through the interaction of spherical wells and a spherical bosses. The lid of the device is secured to the drum assembly by way of a hinge and the bottom surface of the lid has a mirror.

13 Claims, 17 Drawing Sheets

(56) References Cited

U.S. PATENT DOCUMENTS

| | | | | |
|---|---|---|---|---|
| 5,425,971 | A * | 6/1995 | Chiang-Cheng | 428/28 |
| 5,632,394 | A * | 5/1997 | Mecca et al. | 220/824 |
| 5,704,378 | A * | 1/1998 | Machelett | 132/304 |
| 5,769,234 | A * | 6/1998 | Gueret | 206/581 |
| 6,003,203 | A * | 12/1999 | Fowlston | 16/225 |
| 6,014,978 | A * | 1/2000 | Yuhara | 132/293 |
| 6,041,935 | A * | 3/2000 | Yang | 206/581 |
| 6,070,749 | A * | 6/2000 | Joulia | 220/4.22 |
| 6,223,921 | B1 * | 5/2001 | Huang | 220/4.27 |
| 6,227,208 | B1 * | 5/2001 | Imbert | 132/304 |
| 6,302,120 | B1 * | 10/2001 | Kuo | 132/295 |
| 6,378,533 | B1 * | 4/2002 | Roman | 132/295 |
| 6,540,083 | B2 * | 4/2003 | Shih | 206/581 |
| 6,923,335 | B2 * | 8/2005 | Fujita et al. | 220/291 |
| 6,961,977 | B2 * | 11/2005 | Seidler | 16/320 |
| 7,350,525 | B2 * | 4/2008 | Delage | 132/293 |
| 7,614,405 | B2 * | 11/2009 | Allen et al. | 132/295 |
| 7,740,370 | B2 * | 6/2010 | Campbell et al. | 362/135 |
| 7,806,284 | B2 * | 10/2010 | Mangano | 220/4.27 |
| 7,909,205 | B2 * | 3/2011 | Moon | 220/817 |
| 8,109,280 | B2 * | 2/2012 | Winckels et al. | 132/295 |
| 2002/0108628 | A1 * | 8/2002 | Sheng | 132/295 |
| 2004/0129600 | A1 * | 7/2004 | Gueret | 206/581 |
| 2008/0295857 | A1 * | 12/2008 | Gatesoupe | 132/295 |
| 2009/0272659 | A1 * | 11/2009 | Kaiser et al. | 206/235 |
| 2010/0319724 | A1 * | 12/2010 | Chung | 132/295 |

* cited by examiner

COSMETICS STORAGE DEVICE

FIELD OF THE INVENTION

The current invention is a storage device. The invention is particularly well suited to the cosmetics industry as a device for storing cosmetics products.

The cosmetics storage devices of the prior art have numerous problems. For example, many cosmetics storing devices are only capable of storing one type of cosmetic product and the cosmetics storing devices of the prior art that are capable of storing multiple cosmetics do a poor job of keeping each product separate.

Many of the devices store the cosmetics products in small depressions that are all on the same surface. With this configuration it is easy for the products to get mixed together when the device is shaken up, dropped, or even during regular use by the user dropping some of cosmetics product A onto cosmetics product B. There is therefore a need for a device with the ability to store multiple products and get separate from each other.

The invention of the application provides for this need. The device of the invention is capable of storing multiple cosmetics products and keeping them separate and isolated from each other during transportation and everyday use while still providing and easy access to cosmetics products by a user.

The devices of the prior art are also produced from multiple pieces that are joined together in various ways all of which result in a container device that is relatively unreliable and easily broken if the device is dropped from normal heights by a user or subjected to many other everyday stress that a cosmetics storage devices are commonly subjected to.

There is therefore a need for the device to be able to be assembled using sonic welding which increases the durability and reliability of the device and provides for increased machining efficiency. The invention of the application provides for this need. All major parts of the device of the application are secured together via sonic welding.

SUMMARY OF THE INVENTION

The current invention is a storage device, for example, for storing cosmetic products where all of the main components are preferably assembled together using sonic welding. Sonic welding is a well known technique where high-frequency ultrasonic acoustic vibrations are used to join together two pieces of material with a solid-state weld. It is commonly used for welding plastics and for joining dissimilar materials. As all major parts of the device of the current invention are joined by sonic welding, the resulting device is for all practical purposes substantially a monolithic structure with few cracks or seams to trap/lose cosmetics products.

In the preferred embodiments the device is comprised of multiple individual storage drawers that are separate the cosmetics products therein, are easily operable, and can be optionally individually remove and replaced by the user.

In the preferred embodiments the components of the device are generally made of rigid materials, for example, hard plastics or metal.

The lid of the device is attached to the drum top on one side by the lid hinge. This lid rotates around the hinge which allows the lid to open. The lid is preferably held closed by the interface of two magnets, one concealed in the lid and the other concealed in the drum top. Other fasteners can optionally be substituted for the magnets.

In the preferred embodiments, there is a small indention in the front of the lid but not the front of the drum top which allows a user to grip and open the lid, for example, with their finger nail or a coin. In the preferred embodiments, the lid hinge allows for the rotational movement of the lid around the hinge when pressure is applied but is stiff enough to hold the lid in place when the user is not applying pressure to the lid. This allows a user to select the desired position/angle of the mirror on the underside of the lid.

The lid of the device sits on top of the drum assembly which is made up of a drum top, a drum wall, and a drum bottom. The drum top and drum bottom are circular and are about the same diameter as the lid. The drum top and drum bottom are both thin, i.e. their height is drastically less than their diameter, for example, at least 10 times less. The drum bottom can be flat or have a depression in its center. The drum bottom may also optionally have rubber feet to help it grip the surface which the device rests on.

The drum wall is positioned between the drum top and drum bottom. The wall is curved and only partially extends around the bottom surface of the drum top and top surface of the drum bottom. The drum wall interfaces with the drum top and drum bottom through the sonic welding of the guiding grooves in the drum top and drum bottom and the guiding rib on the top and bottom surfaces of the drum wall. In the preferred embodiments the drum wall makes up the majority of the height of the device. The outside surface of the drum wall can either be smooth or textured.

The drum assembly creates a cavity where the drawers of the device can be housed. The device has at least two drawers. Each drawer of the device can be identical or different. In the preferred embodiment the drawers are generally circular in shape. One side of the drawers can optionally be straight with the proviso that this straight side is hidden within the drum assembly when the drawers are in the closed position.

The top surface of the drawers has a depression that creates a cavity for products to be stored. For example, make-up or other cosmetics products can be stored in the drawers. In some embodiments the bottom surface of the depression in the drawer is made of a metal, for example, aluminum or steel.

The drawers are attached to the drum top, the drum bottom, and to each other by the interface between spherical bosses and spherical wells. Spherical bosses are a male protrusion and the spherical wells are a complementary female portion. For example, the spherical bosses can be a half dome protrusion and the spherical wells can be a complementary shaped pit. In some embodiments the spherical boss is a cylinder shaped protrusion and the spherical well is a cylinder shaped pit. The spherical bosses and wells can be any shape as long as they allow for rotational movement around one axis to allow the drawers to rotate in and out of the drum assembly when they interface.

In some embodiments the drum top, drum bottom, and the bottom side of each drawer have spherical wells, and the top sides of each drawer have spherical bosses. In these embodiments the bottom side of the bottom most drawer has a spherical boss instead of a spherical well so that it can interface with the spherical well of the drum bottom. In some embodiments the placement of spherical wells and bosses are reversed. Any positioning of spherical wells and bosses is acceptable as long as a spherical well and a spherical boss meet at any given interface. The interface of the of spherical wells and spherical boss must also provide for the rotation of the drawers around a single axis that allows them to rotate in and out of the drum assembly.

In some embodiments each drawer has a bump on its outer wall that helps the drawer to be gripped by a human. The portion of the outer wall of the drawer that is exposed while in the close position has a lip, that when in the closed position, provides a relatively seamless transition between the drum wall and the drawers.

In the preferred embodiment, the invention is a cosmetics storage device that is made up of:

A. a drum assembly comprising:

i. a drum top, ii. a drum wall, and iii. a drum bottom;

B. a lid where the lid has a bottom surface with a mirror attached to said bottom surface, and where the lid is positioned on top of a top surface of the drum top and attached to the drum assembly by a lid hinge; and C. at least two drawers nested in the drum assembly when in a closed position where the top surface of one drawer is attached to a bottom surface of the drum top through an interface between a spherical well and a spherical boss, the bottom surface of one drawer is attached to a top surface of the drum bottom through an interface between a spherical well and a spherical boss, the top and bottom surfaces of at least two drawers are attached to each other through an interface between a spherical well and a spherical boss, where the interface between the spherical boss and spherical well allows for rotational movement of each drawer independently along one axis and allows the drawers to rotate independently into and out of the drum assembly, and where said drawers have depressions capable of containing cosmetics products this is described in more detail below.

In some embodiments, the cosmetics storage device the lid is made up of i. a lid dome, and ii. a lid base.

In some embodiments, the lid dome is attached to the lid base by sonic welding of a lid dome rib and a lid base groove this is described in more detail below.

In some embodiments, the lid hinge is a lid knuckle hinge this is described in more detail below.

In some embodiments, the lid hinge is positioned inside a lid hinge cavity in the drum wall and secured in the lid hinge cavity by lid hinge retainers in the drum top this is described in more detail below.

In some embodiments, the lid hinge retainers are sonically welded into the lid hinge cavity this is described in more detail below.

In some embodiments, the drum top and the drum bottom are attached to the top and bottom surface of the drum wall, respectively, through the sonic welding of guiding ribs on the top and bottom surfaces of the drum wall to the guiding grooves on the bottom surface of the drum top and the top surface of the drum bottom this is described in more detail below.

In some embodiments, all of the drawers have one spherical boss and one spherical well this is described in more detail below.

In some embodiments, one spherical boss or spherical well is positioned on the top surface of the drawer and one of the spherical boss or spherical well is positioned on the bottom surface of the drawer this is described in more detail below.

In some embodiments, all spherical bosses and spherical wells of the device are vertically aligned this is described in more detail below.

In some embodiments, the spherical bosses and spherical wells are positioned on the drawers so that the spherical bosses only interact with spherical wells and spherical wells only interact with spherical bosses this is described in more detail below.

In some embodiments, each drawer contains either two spherical bosses, two spherical wells, or one spherical boss and one spherical well this is described in more detail below.

In some embodiments, the device has at least three drawers, and wherein the drawers that are not attached to the drum top or the drum bottom are attached to two other drawers through the interface between a spherical well and a spherical boss this is described in more detail below.

In some embodiments, magnets in the lid base and the drum top are positioned to be vertically aligned with each other and are capable of securing the lid to the drum top via magnetic attraction this is described in more detail below.

DETAILED DESCRIPTION OF THE INVENTION

Figure 1:
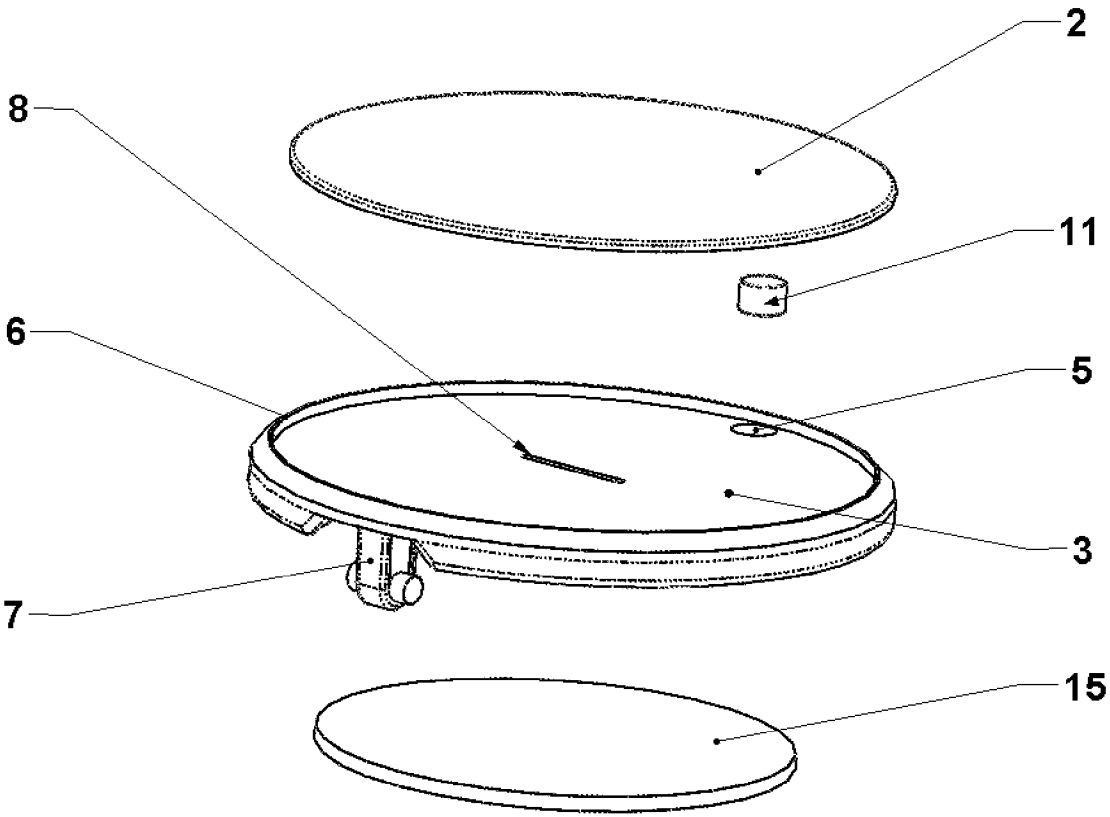
FIG. 1 is an exploded view of the lid showing the top and side surfaces from a back and side perspective.
Figure 2:
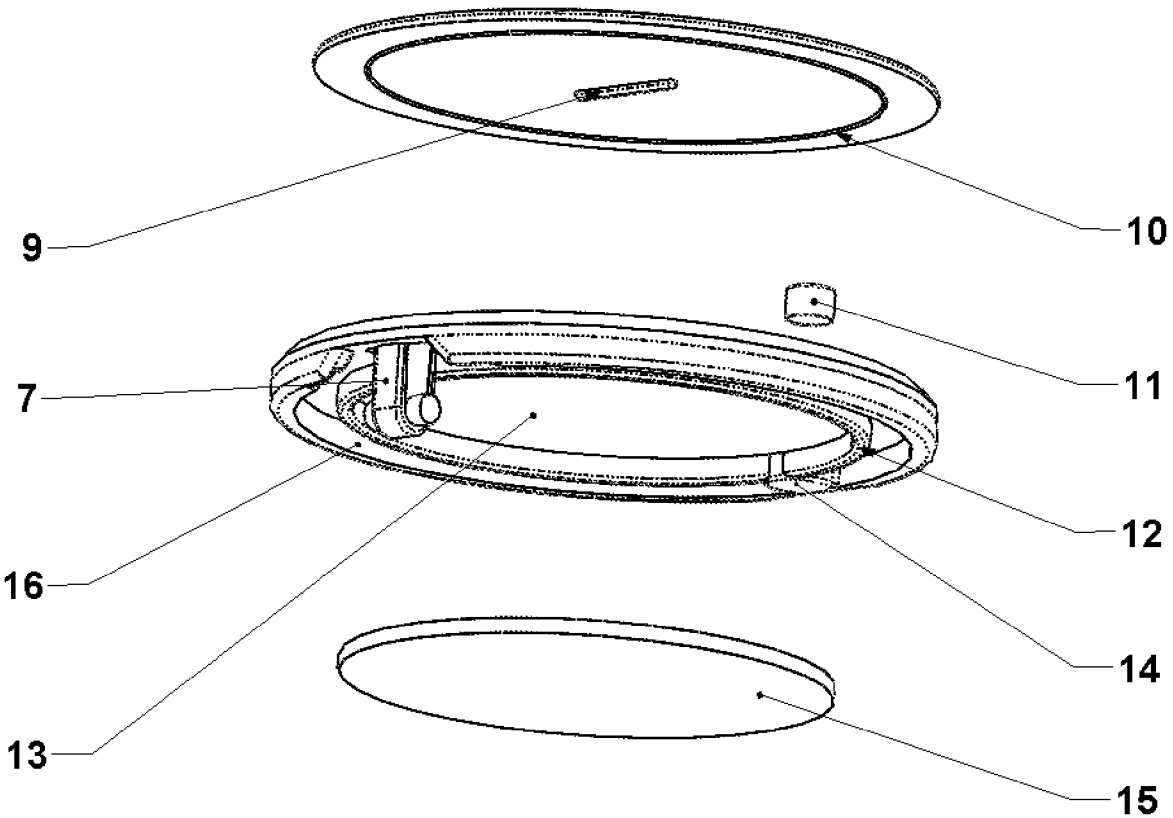
FIG. 2 is an exploded view of the lid showing the bottom and side surfaces from a back and side perspective.
Figure 3:
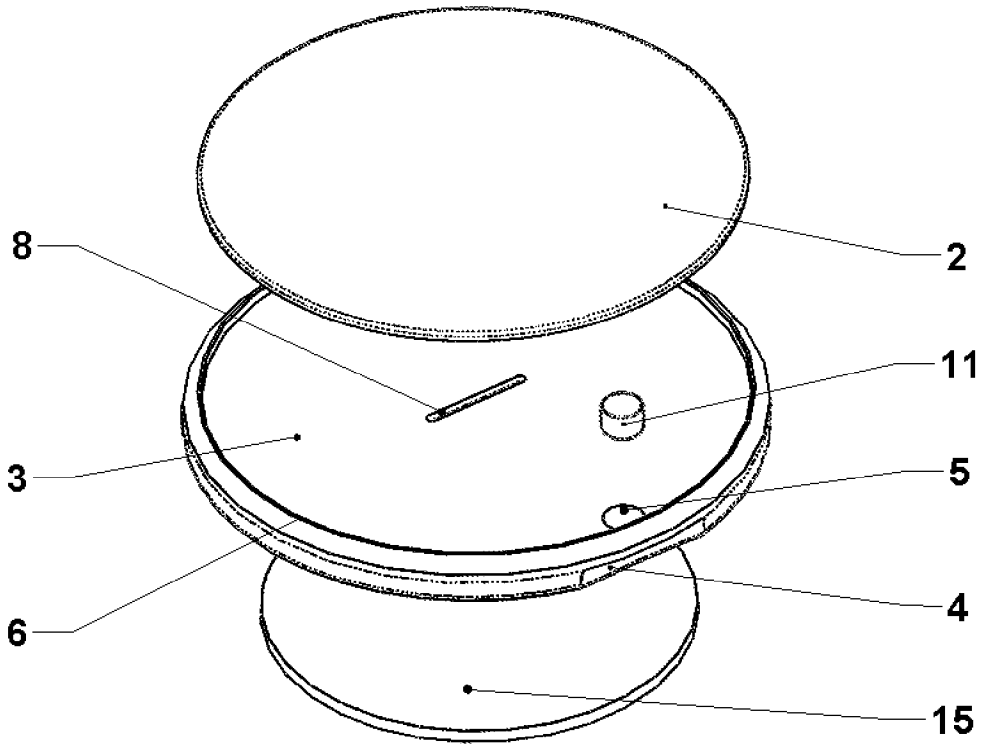
FIG. 3 is an exploded view of the lid showing the top and side surfaces from a front and side perspective.
Figure 4:
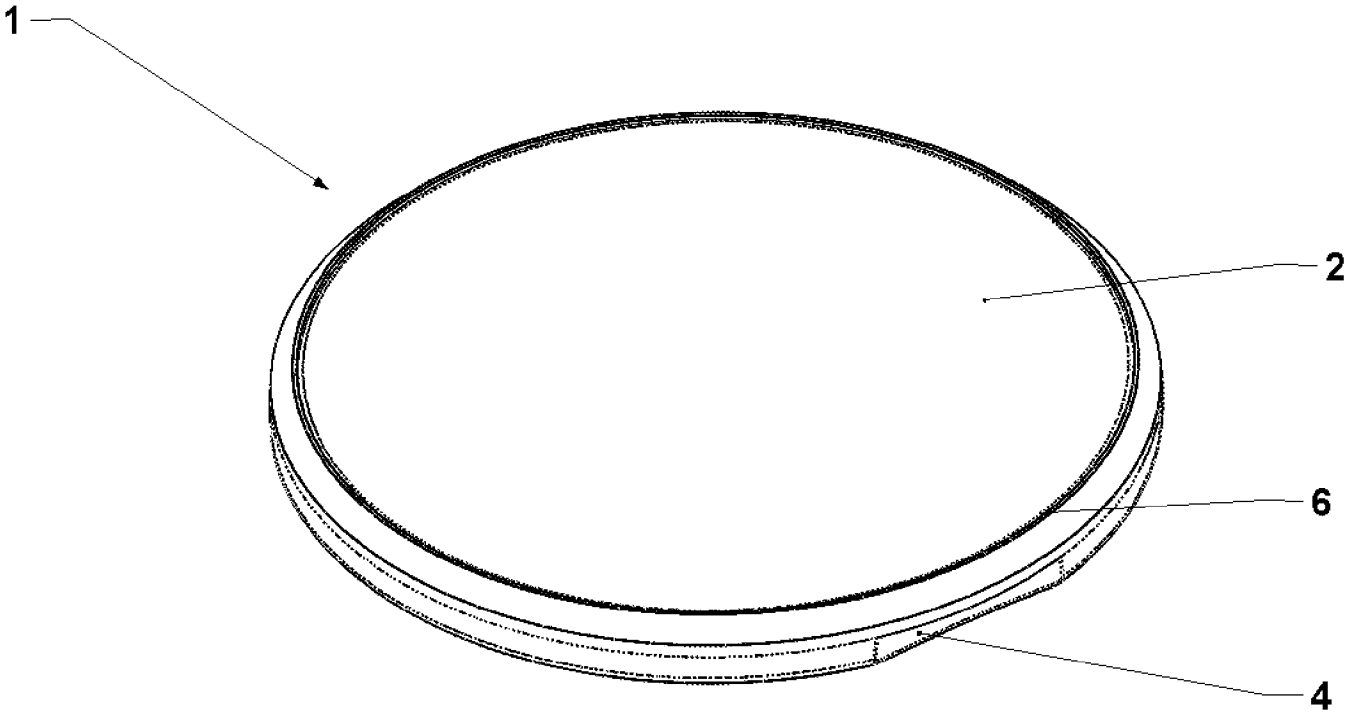
FIG. 4 is a front and side perspective view of the top and side of the assembled lid.
Figure 5:
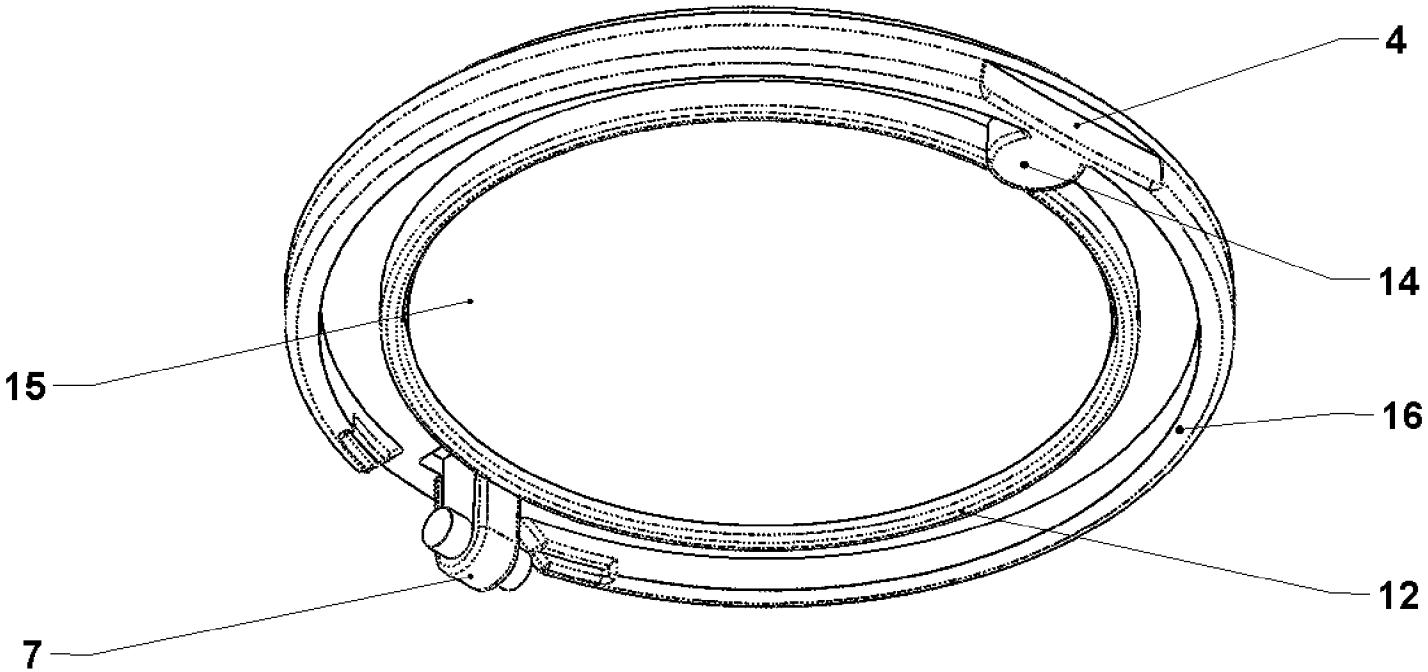
FIG. 5 is a side perspective view of the bottom and side of the assembled lid.
Figure 6:
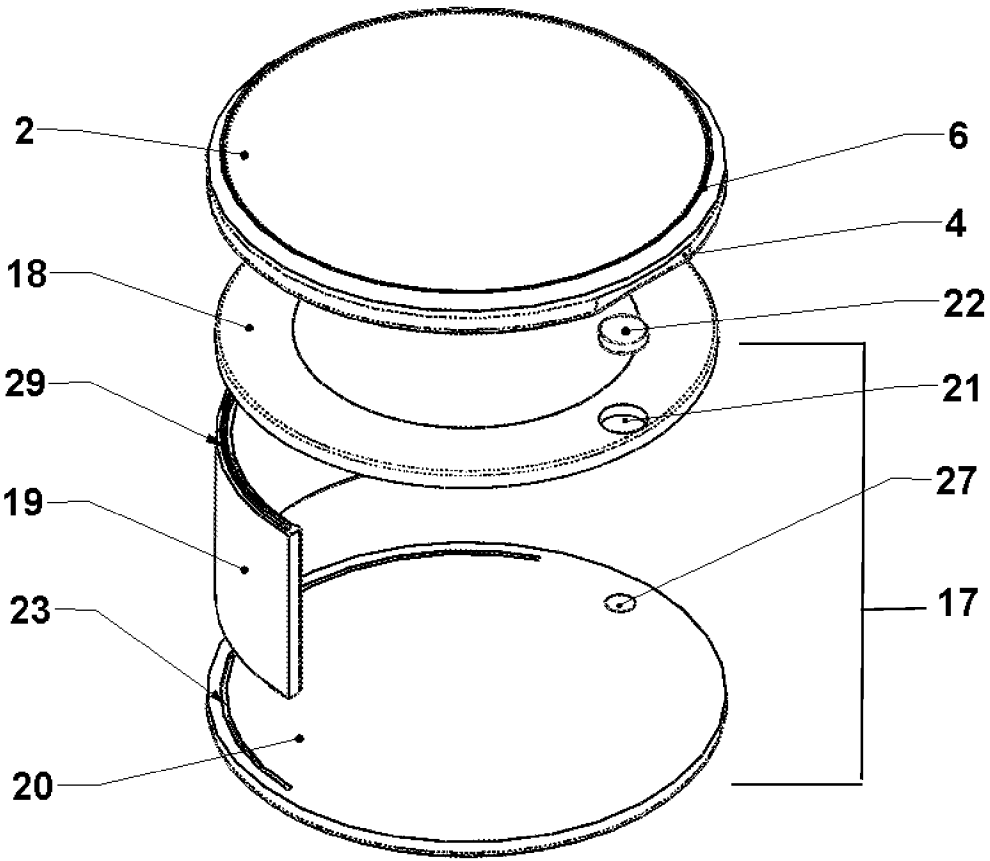
FIG. 6 is an exploded view of the lid and drum assembly showing the top and side surfaces from a front and side perspective.
Figure 7:
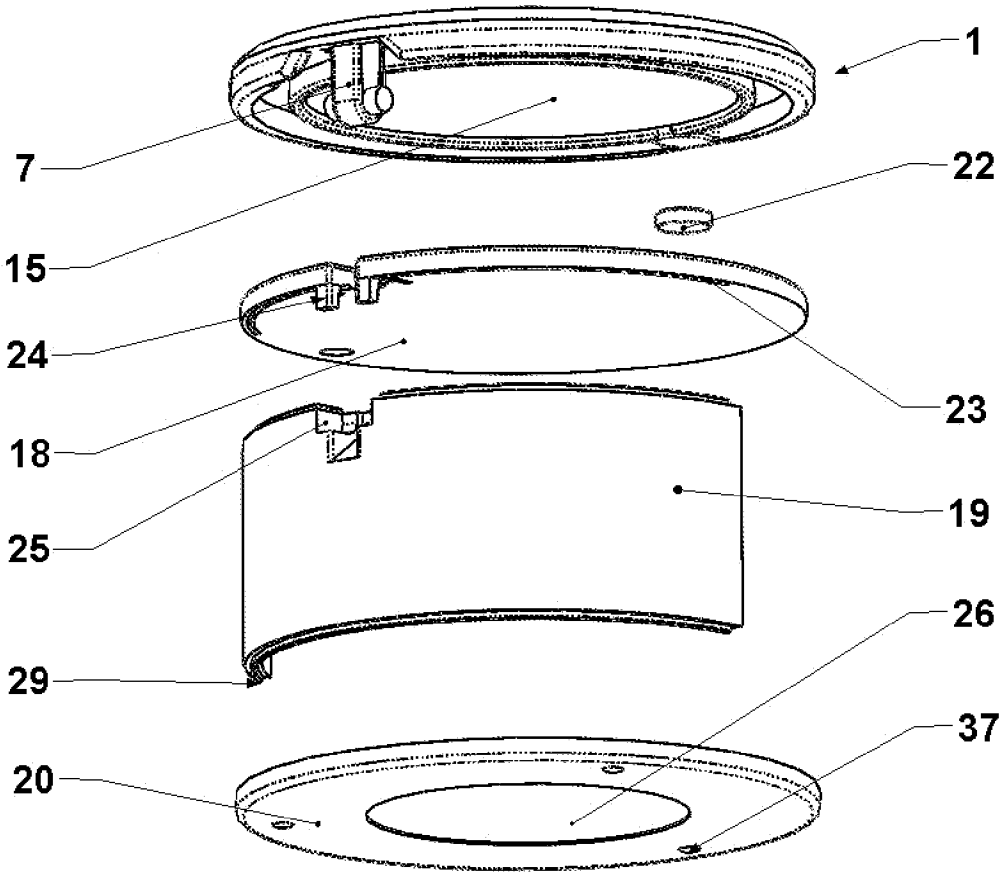
FIG. 7 is an exploded view of the lid and drum assembly showing the bottom and side surfaces from a back and side perspective.
Figure 8:
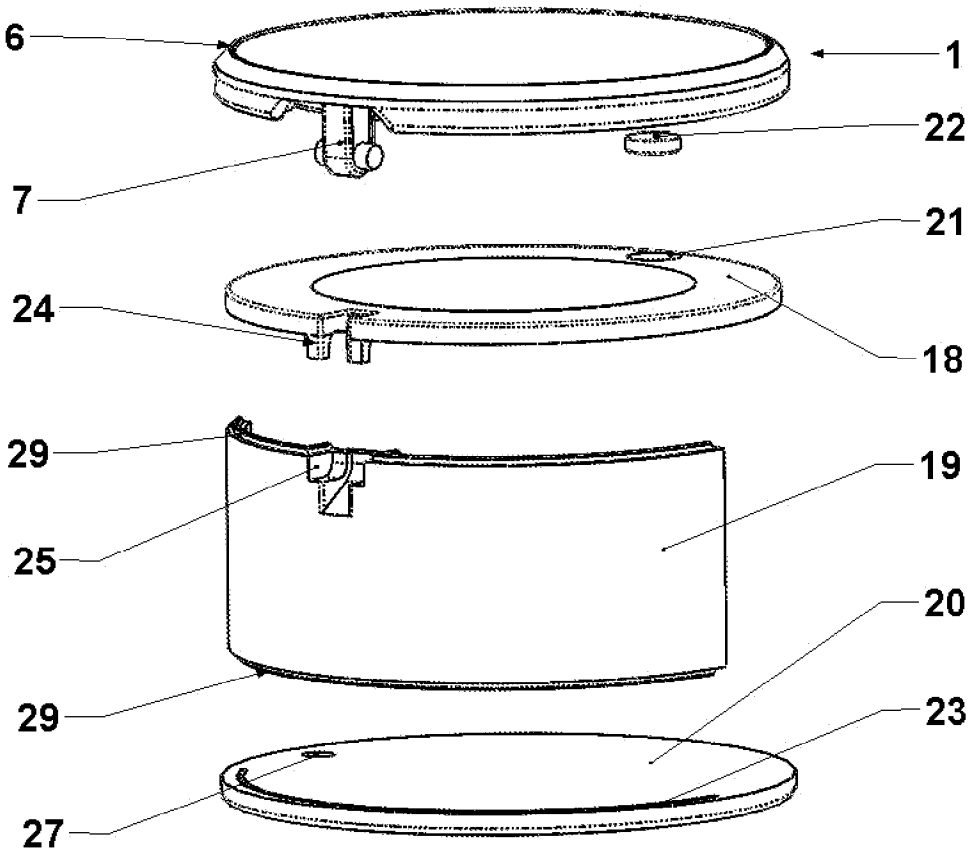
FIG. 8 is an exploded view of the lid and drum assembly showing the top and side surfaces from a back and side perspective.
Figure 9:
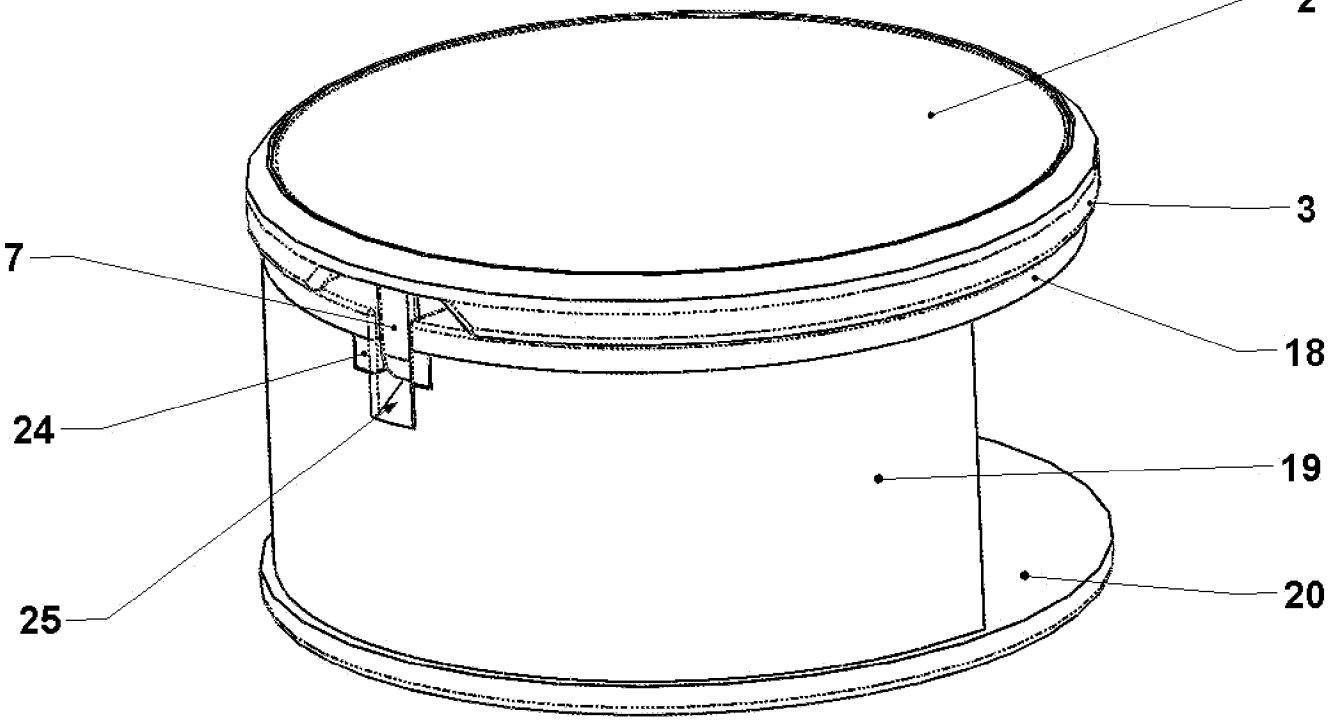
FIG. 9 is a back and side perspective view of the top and side of the assembled lid and drum assembly with the lid in a closed position.
Figure 10:
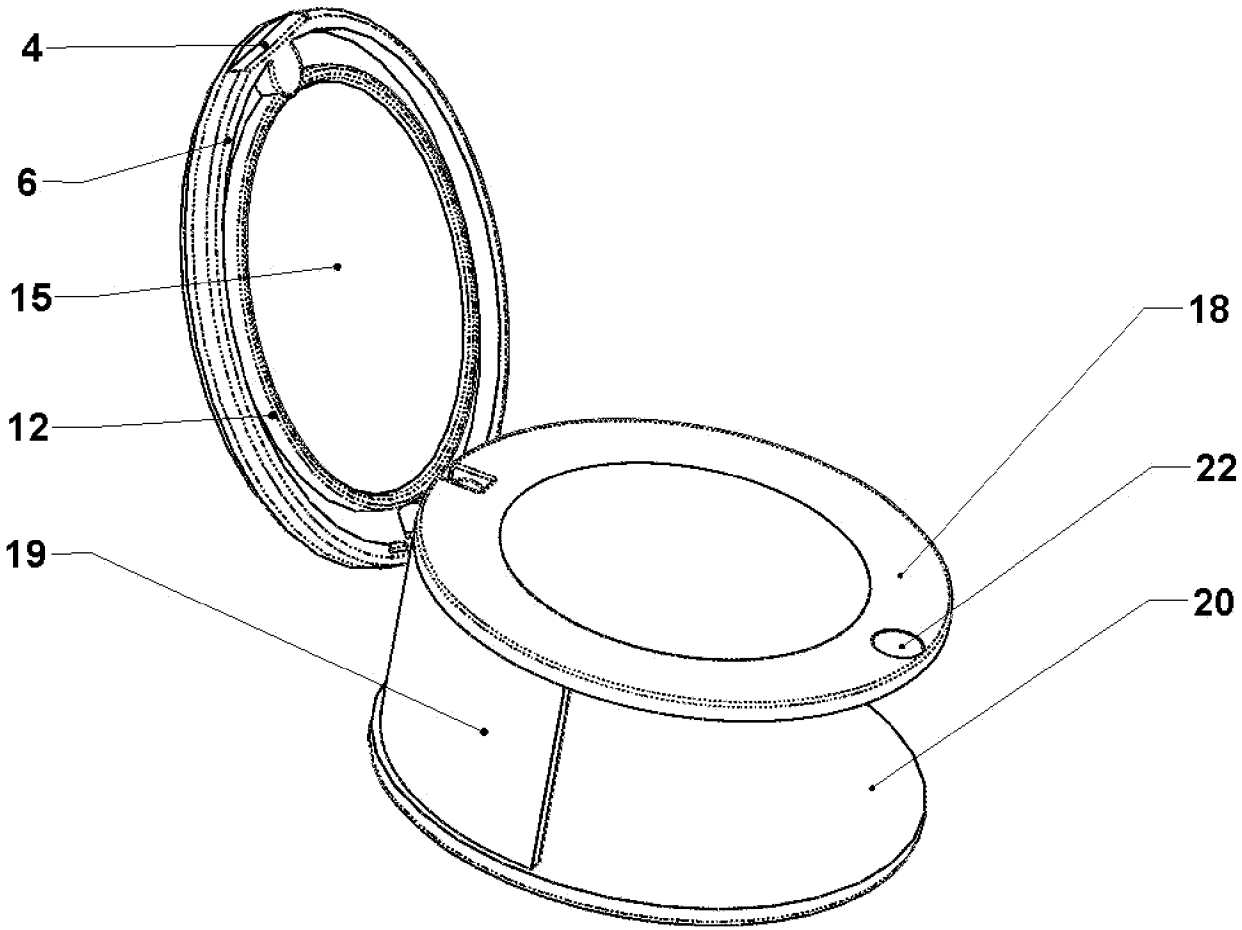
FIG. 10 is a top perspective view of the assembled lid and drum assembly with the lid in an open position.
Figure 11:
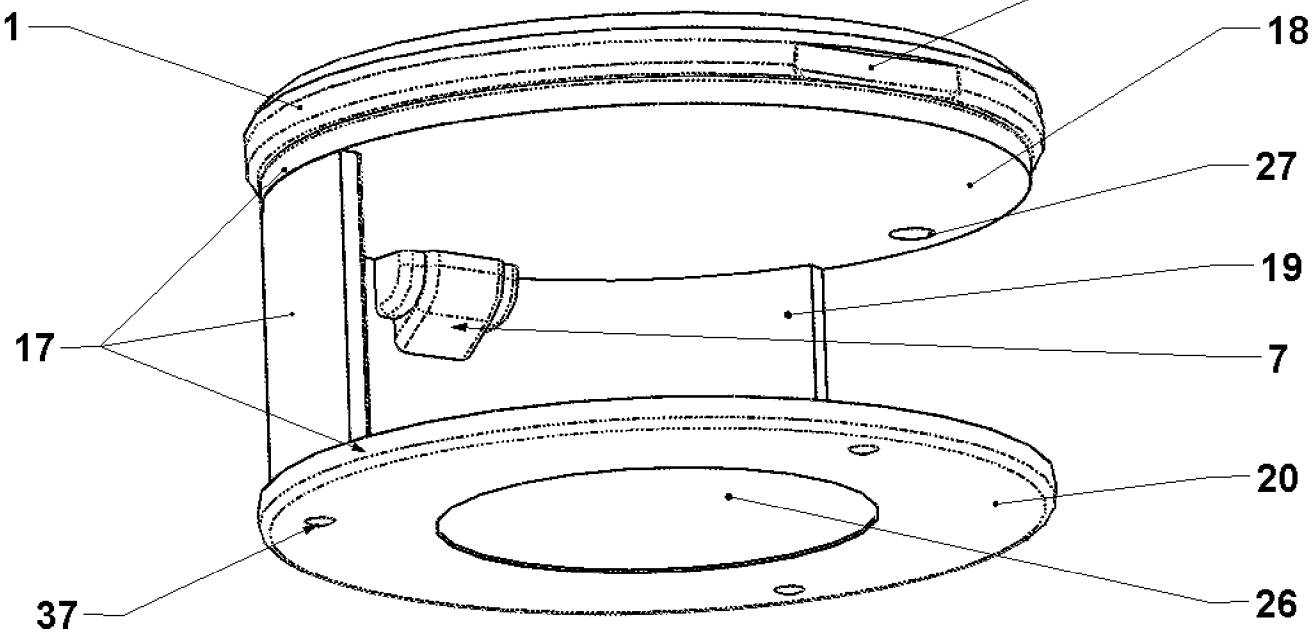
FIG. 11 is a front perspective view of the bottom and front of the assembled lid and drum assembly with the lid in a closed position.
Figure 12:
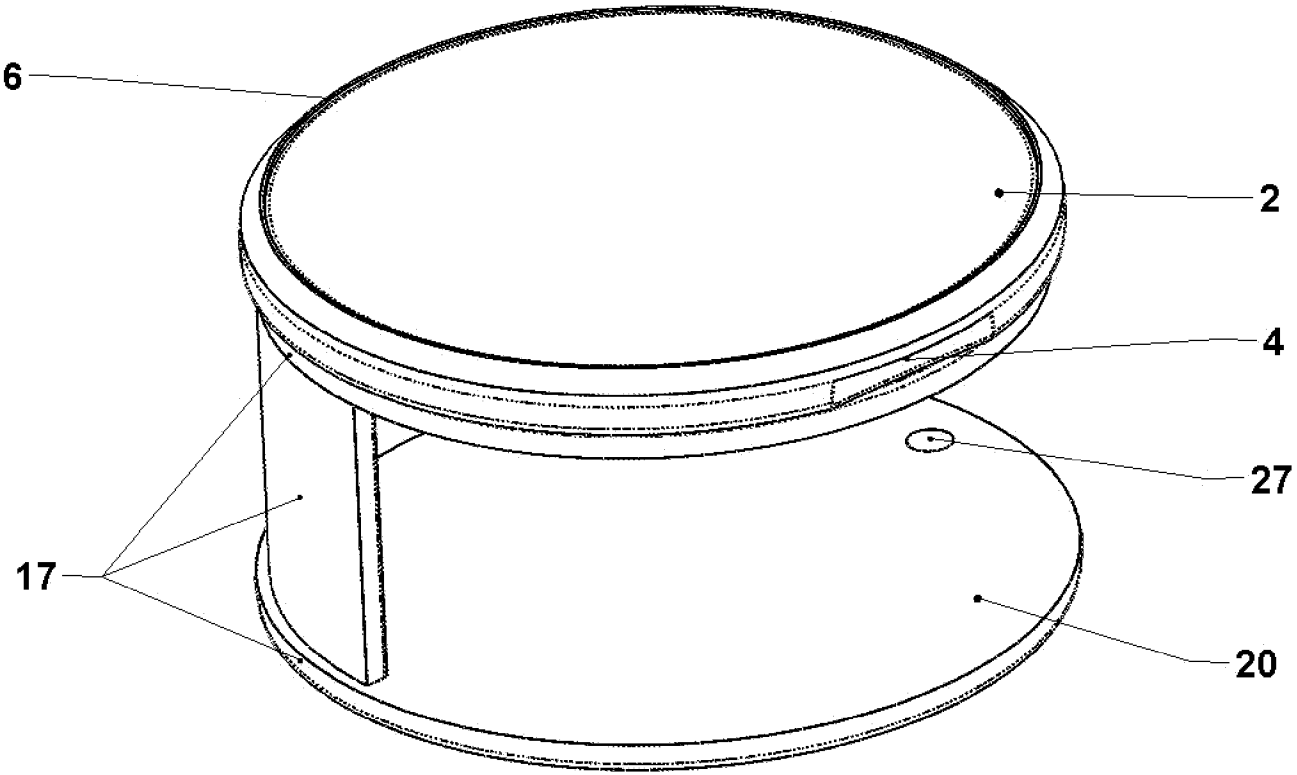
FIG. 12 is a top and front perspective view of the top and front of the assembled lid and drum assembly with the lid in a closed position.
Figure 13:
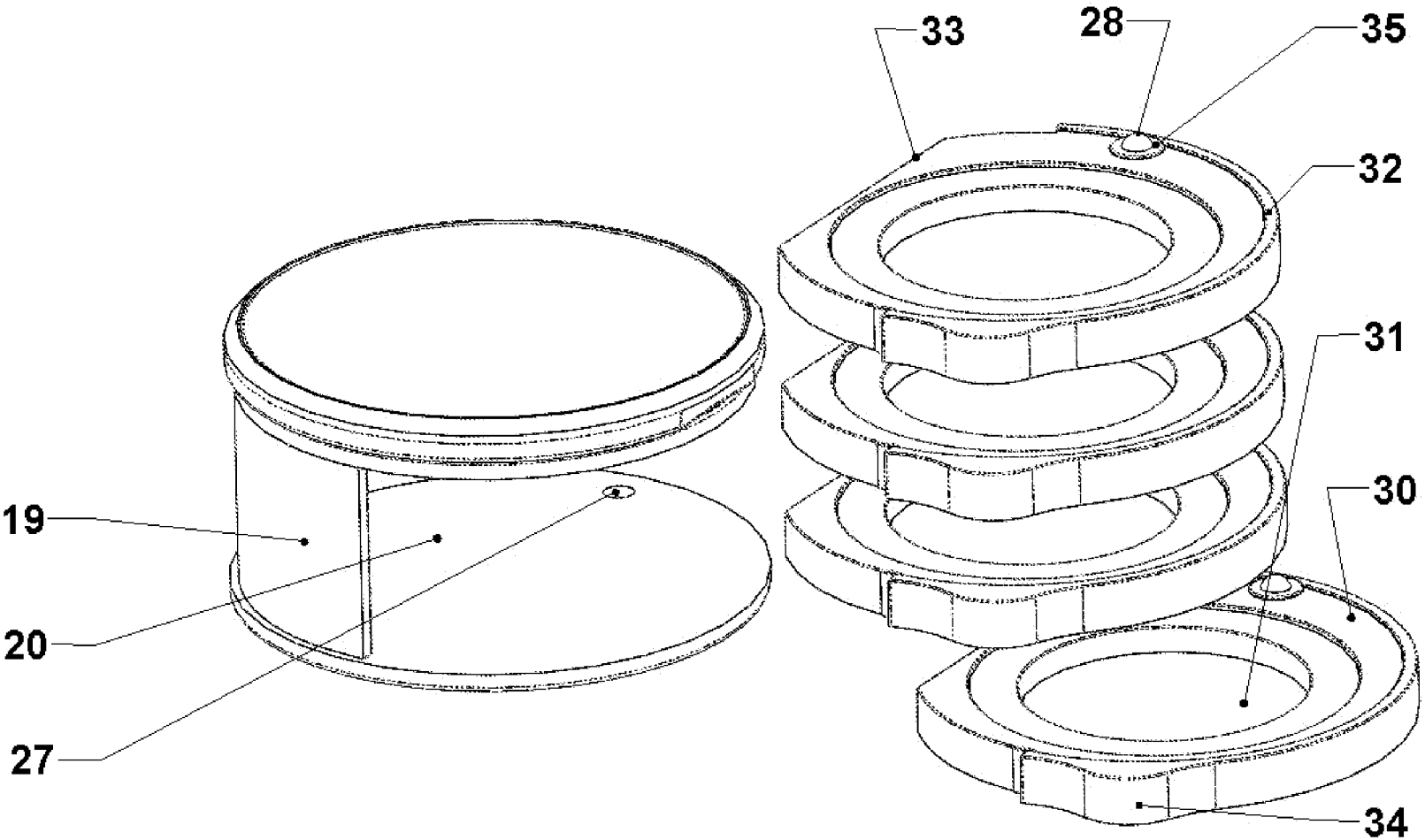
FIG. 13 is a top and side perspective view of the assembled lid and drum assembly with the lid in a closed position and unassembled drawers.
Figure 14:
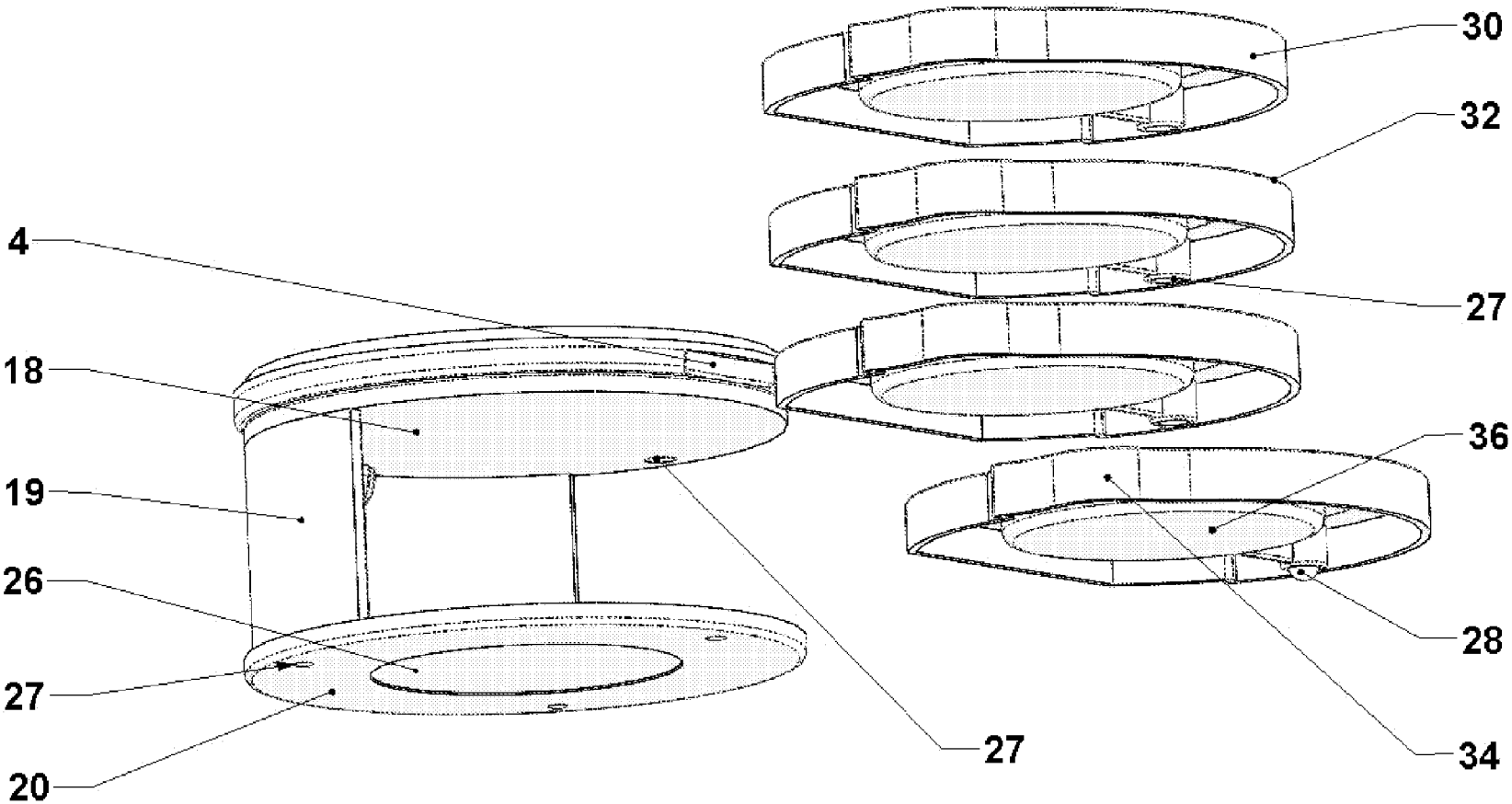
FIG. 14 is a bottom and side perspective view of the assembled lid and drum assembly with the lid in a closed position and unassembled drawers.
Figure 15:
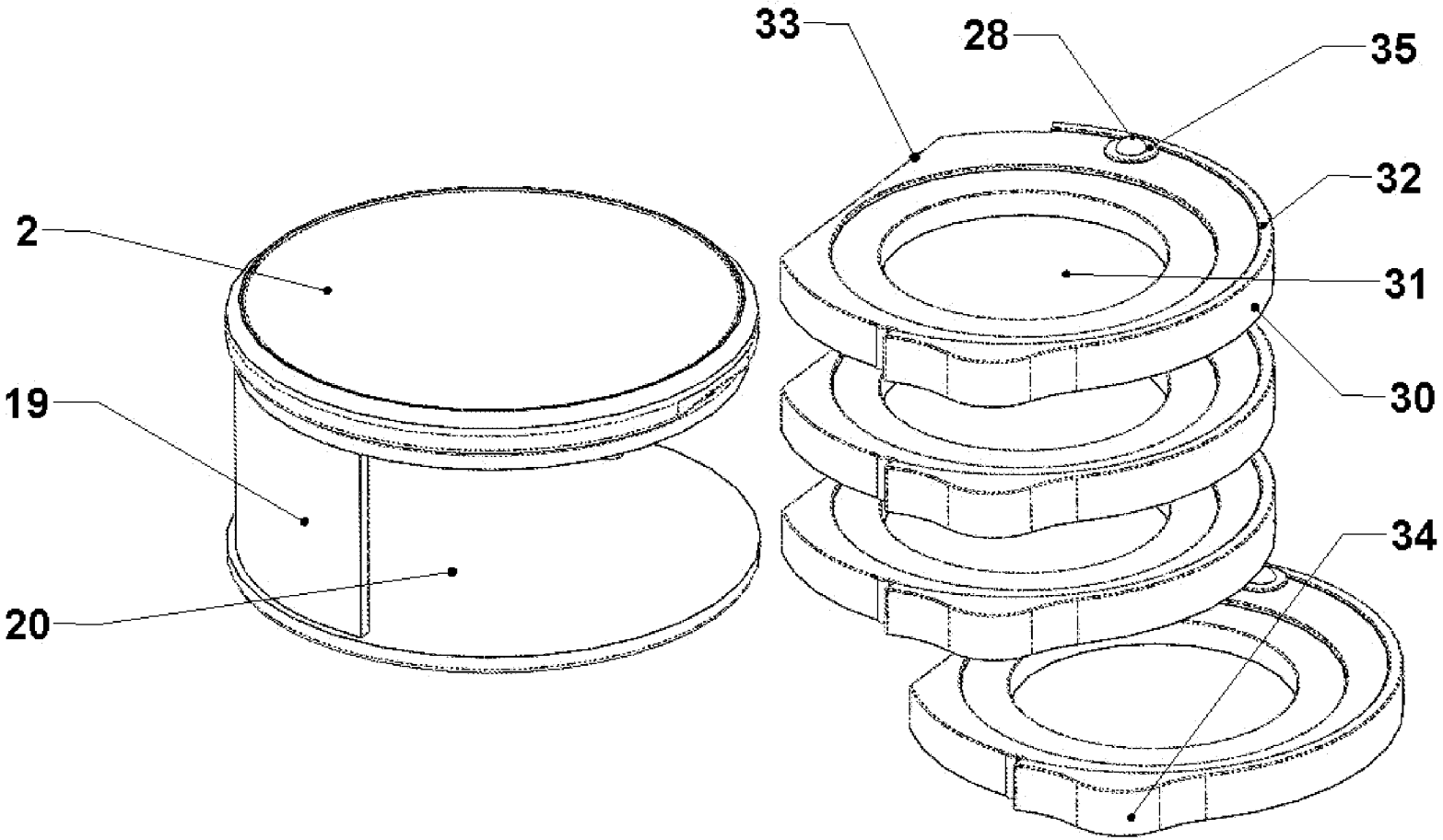
FIG. 15 is another top and side perspective view of the assembled lid and drum assembly with the lid in a closed position and unassembled drawers.
Figure 16:
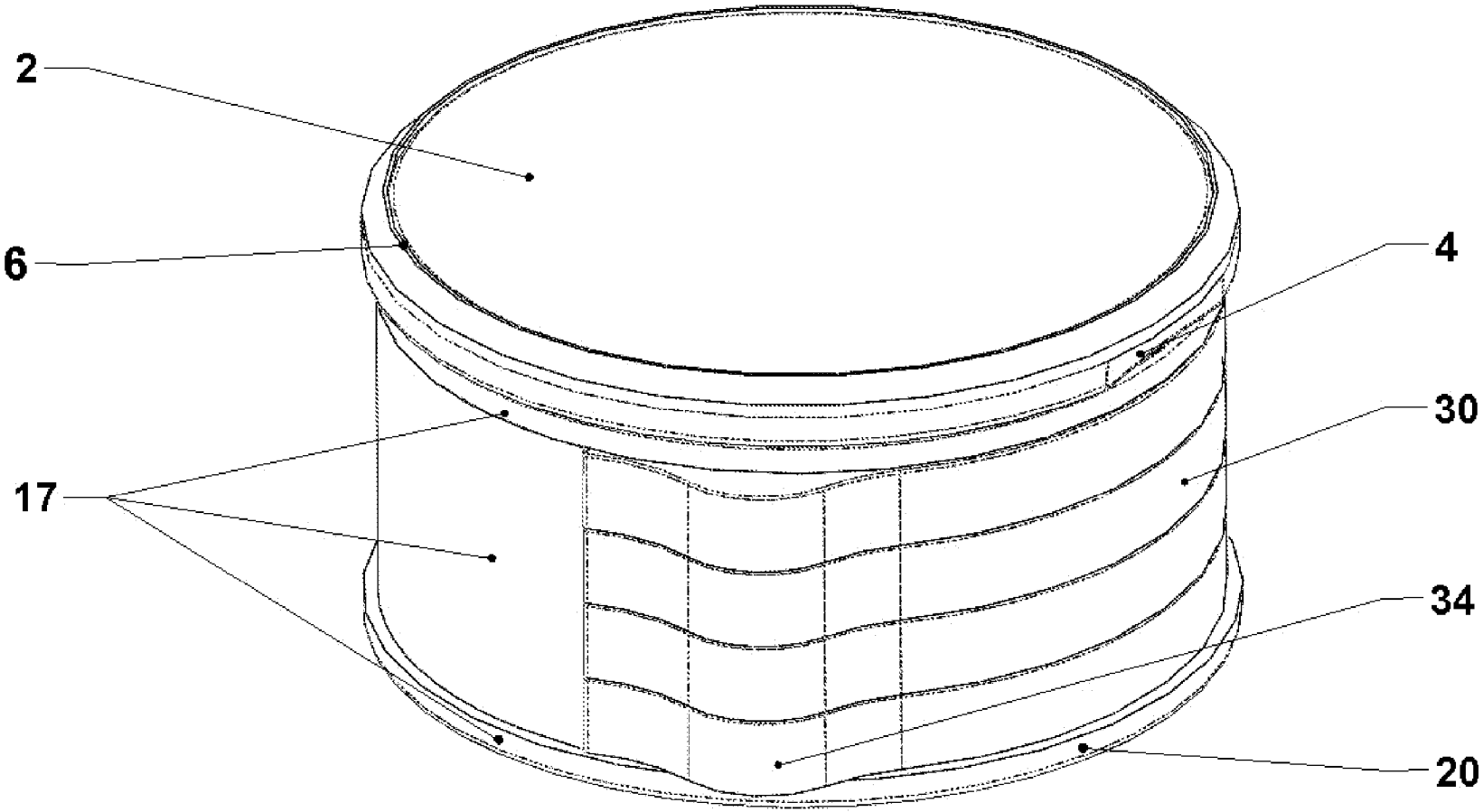
FIG. 16 is a top and side perspective view of the assembled device in the closed position.
Figure 17:
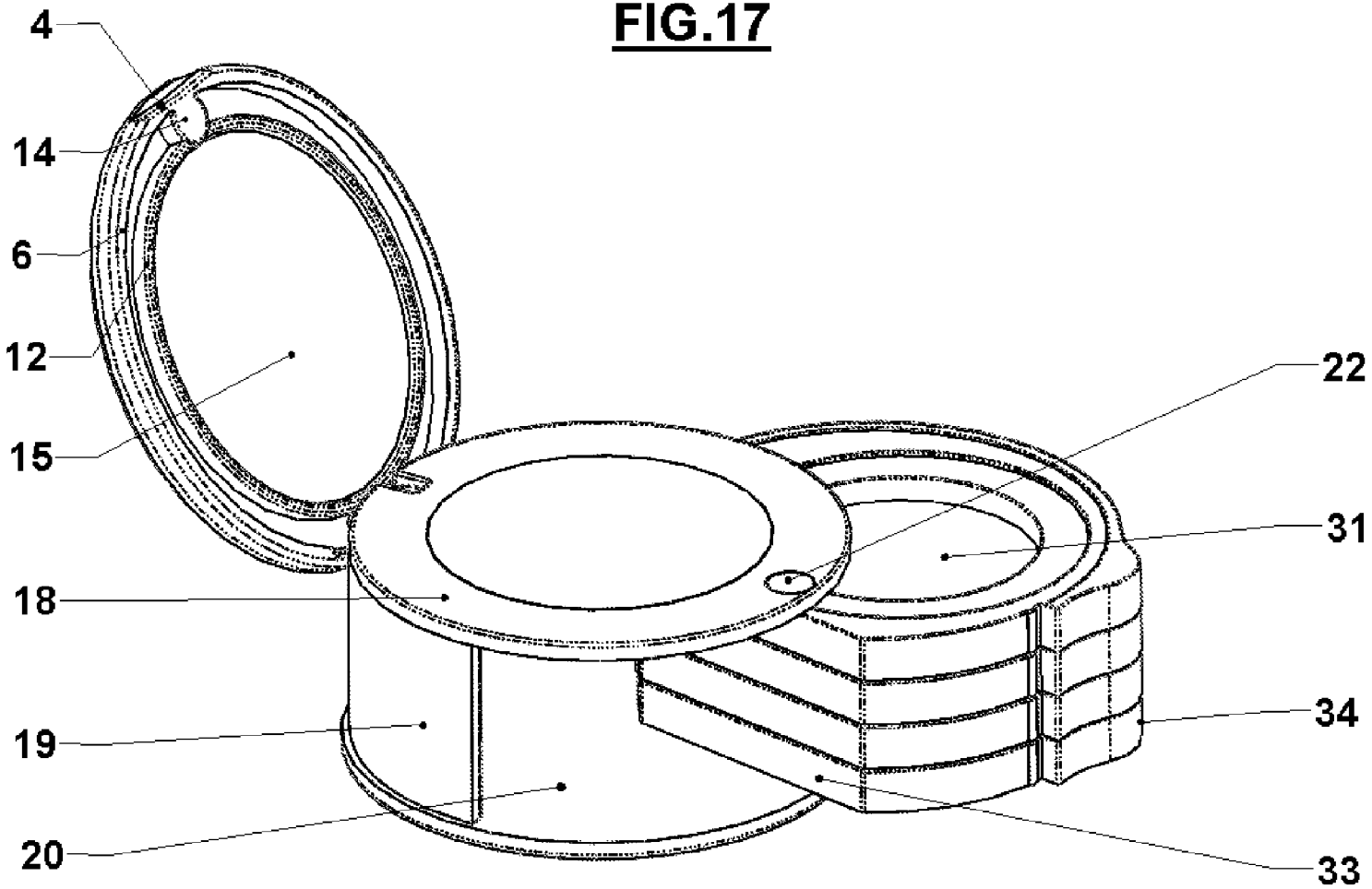
FIG. 17 is a top and side perspective view of the assembled device with the lid and drawers in the open position.

In a preferred embodiment, the lid (1) is made up of a lid dome (2) and a lid base (3). In a preferred embodiment, the lid dome (2) is generally circular in shape and is attached to a generally circular in shape lid base (3). The top and bottom surfaces of the lid dome (2) are generally flat. In some embodiments, the bottom surface of the lid dome (2) has a lid dome rib (9) that interfaces with lid base groove (8) of the lid base (3). In some embodiments, the lid dome rib (9) and lid base groove (8) can be sonically welded together. In some embodiments the bottom surface of the lid dome (2) also has a ring (10) extending slightly from the bottom surface, for example, from 0.5 mm-5 mm from the bottom surface. This ring (10) facilitates the sonic welding of the lid dome (2) to the lid base (3).

In some embodiments, the lid base has thin raised side walls (6) of a height that is the same or close to the same as the thickness of the sides of the lid dome (2), so as to provide a smooth transition between the sides of the lid dome (2) and the lid base (3). In some embodiments, a portion of the side walls (6) is indented. This indented portion (4) is positioned adjacent to the first magnet cavity (5). In some embodiments, this indented portion (4) is in the shape of an inward arch with the center of the arch (the thinnest point) aligned with the center of the first magnet cavity (5). This indented portion (4) provides a grip surface for a human finger or finger nail to grip the lid base (3) to facilitate the opening of the lid (1).

In some embodiments, the center of the top surface of the lid base (3) has a lid base groove (8) for interfacing with the lid dome rib (9) in the lid dome (2). As discussed above this facilitates the sonic welding of the lid dome (2) to the lid base (3). In some embodiments, the top surface of the lid base (3) also has a first magnet cavity (5) capable of accepting a first magnet (11). This first magnet cavity (5) is located at or close to the edge of the top surface of the lid base (3). In some embodiments, when the device is assembled, a first magnet (11) is placed inside the first magnet cavity (5) on the top surface of the lid base (3) and the lid dome (2) secured to the lid base (3) covering the top surface of the lid base (3) so neither the first magnet (11) nor the first magnet cavity (5) is visible.

In a preferred embodiment, the bottom surface of the lid base (3) has a ring (12) that creates a mirror cavity (13) that is generally circular in shape. In some embodiments, the ring (12) is positioned so that its center is aligned with the center of the bottom surface of the lid base (3). In some embodiments, the ring (12) abuts or nearly abuts the projection (14) caused by the first magnet cavity (5) in the top surface of the lid base (3). In some embodiments, the height of the edges of the ring (12) is the same or nearly the same as the projection (14). In some embodiments, a mirror (15) is placed in and secured in the mirror cavity (13).

In some embodiments, the bottom surface of the lid base (3) has a lid hinge (7), for example, a knuckle lid hinge. In some embodiments, the lid hinge (7) is positioned outside of the ring (12) and directly opposite to or nearly directly opposite to the first magnet cavity (5). In some embodiments, the bottom surface of the lid base (3) also has a lip (16) along most of its outer edge that protrudes at a height equal to or greater than the height of the ring (12) and projection (14). In some embodiments, the lid hinge (7) and projection (14) are positioned in-between the ring (12) and the lip (16). In some embodiments, there is a brief break in the lip (16) around the lid hinge (7). This break allows the lid (1) to open by pivoting at the lid hinge (7).

In the preferred embodiments, the lid (1) is attached to the top of a drum assembly (17). In the preferred embodiments, the drum assembly (17) comprises a drum top (18), a drum wall (19), and a drum bottom (20).

In a preferred embodiment, a drum top (18) is positioned directly below the lid (1). In some embodiments, the drum top (18) is of a similar shape to the lid (1) but is smaller in circumference than the lid (1). In some embodiments the drum top (18) is the same size or larger than the lid (1). In some embodiments, the drum top (18) has a generally flat top surface and is capable of fitting inside the ring (12) created by the lip (16) of the lid (1). In some embodiments, the drum top (18) has a second magnet cavity (21) which can receiver a second magnet (22).

In some embodiments, the drum top (18) also has lid hinge retainers (24) capable of fitting in or partially fitting in the lid hinge cavity (25) and securing or helping to secure the lid hinge (7) in the lid hinge cavity (25). In some embodiments, the lid hinge retainers (24) are positioned directly opposite to or nearly opposite to the second magnet cavity (21). When assembled, the second magnet cavity (21) is positioned to line up with the first magnet cavity (5) on the lid base (3) and the lid hinge retainers (24) are positioned to line up with the lid hinge (7) on the lid base (3).

In the preferred embodiments, the lid hinge (7) is placed into the lid hinge cavity (25). The lid hinge retainers (24) are then place over the lid hinge (7) and into the lid hinge cavity (25). The lid hinge retainers (24) are then sonically welded into the lid hinge cavity (25) so that the lid hinge (7) is secured in the lid hinge cavity (25) but still allowed to rotate within the lid hinge cavity (25).

In some embodiments, the bottom surface of the drum top (18) is generally flat with a guiding groove (23) near the outer edges of the bottom surface of the drum top (18) that extends around a portion of the bottom surface of the drum top (18). The guiding groove (23) is a small depression in top surface of the drum top (18) that is compatible with and capable of interfacing with the guiding rib (29) in the top surface of a drum wall (19).

In the preferred embodiments, the bottom surface of the drum top (18) has a spherical well (27). The spherical well (27) is capable of receiving a spherical boss (28) on the top surface of the drawers (30). In some embodiments, the spherical well (27) is positioned close to the outside edge of the bottom surface of the drum top (18). In some of these embodiments, the spherical well (27) is positioned in the section of the bottom surface of the drum top (18) that is not also occupied by the drum wall (19). In some of these embodiments, the spherical well (27) is positioned at a portion of the bottom surface of the drum top (18) that is not aligned with the lid hinge cavity (25).

In a preferred embodiment, a drum wall (19) is secured to the bottom surface of the drum top (18) and to the top surface of the drum bottom (20). In some embodiments, the top surface and the bottom surface of the drum wall (19) have a guiding rib (29) that fits inside the guiding groove (23) of the bottom surface of the drum top (18) and the top surface of the drum bottom (20), respectively. In some embodiments, the height of the guiding rib (29) is the same or about the same as the depth of the guiding groove (23) such that the bottom surface of the drum top (18) and the top surface of the drum wall (19) (that is not the guiding groove (23) or guiding rib (29)) will touch or almost touch when the device is assembled. In some embodiments, the guiding rib (29) is sonically welded into the guiding groove (23). The interface of the top surface of the drum bottom (20) and the bottom surface of the drum wall (19) functions in the same way. In some embodiments the guiding rib (29) on the top surface of the drum wall (19) is interrupted by the lid hinge cavity (25).

In some embodiments, the drum wall (19) extends only about halfway around the circumference of the drum top (18). In some embodiments, the lid hinge cavity (25) is positioned at the center point of where the drum wall (19) is secured to the drum top (18) and is capable of receiving the lid hinge (7) and the lid hinge retainers (24).

In some embodiments, the drum wall (19) has a height that makes up the majority of the height of the entire device. In some embodiments, the height of the drum wall (19) can be between 3 cm-30 cm. In some embodiments, the height of the drum wall (19) can be between 5 cm-10 cm, for example 6 cm, 7 cm, 8 cm, or 9 cm. In some embodiments the drum wall (19) is a height suitable for containing between 2 and 10 drawers (30). In some embodiments the drum wall (19) is a height suitable for containing between 3 and 5 drawers (30), for example, 4 drawers (30).

In the preferred embodiments, the drum wall (19) is capable of receiving multiple drawers (30).

In some embodiments, the outer surface of the drum wall (19) is generally smooth. In some embodiments, the outer surface of the drum wall (19) may be textured to enhance the ability for a human to grip it. In some embodiments, the outer surface of the drum wall (19) may be coated with an easy to grip substance, for example, rubber to enhance the ability for a human to grip it.

In the preferred embodiments, multiple drawers (30) are housed within the drum assembly (17). The drawers (30) are generally circular in shape and have a circumference that allows them to fit inside the drum assembly (17) with minimal negative space. In some embodiments, all the drawers (30) in a given device are identical or nearly identical. In some embodiments each drawer (30) is different.

In some embodiments, the top surface of the drawer (30) has at least one depression (31) that forms a cavity suitable for containing a powdered, solid, or viscous substance, for example, beauty products. In some embodiments, the depression (31) comprises multiple depressions where one depression is at least twice as deep as the other depressions and where the deeper depression is closest to the center.

In some embodiments, a portion of the outside edge or top surface of the drawer (30) has a slightly raised lip (drawer lip (32)). In some embodiments the height of the drawer lip (32) is the same or nearly the same throughout. In some embodiments, this drawer lip (32) only occurs on the edge portions which are not within the drum wall (19) when in the closed confirmation. In these embodiments the drawer lip (32) terminates such that the terminal edge of the drawer lip (32) meets or almost meets the terminal edge of the drum wall (19). In these embodiments the combination of the drum wall (19) and the drawer lips (32) form an outside surface that is the same height all the way around the device.

In some embodiments, the portion of the drawer (30) hidden by the drum wall (19) while in the closed configuration has an edge portion of the drawer (30) removed so as to create a straight line edge (33) from the previously generally circular edge. In some embodiments, the midpoint in the straight line edge (33) is positioned to be directly across from the midpoint in the drawer lip (32). In some embodiments, the mid point of the straight line edge (33) is close to the beginning of the depression (31) in the top surface, for example, within about 1 mm. In these embodiments, therefore, the depression (31) in the top surface remains generally circular. In some embodiments, the depression (31) has a generally flat bottom. In some embodiments the bottom surface of the depression (31) is a metal pan, for example, stainless steel, aluminum, or titanium.

Please note that in the embodiments with a straight line edge (33), the language above relating to "removing," does not mean that a portion of the drawer (30) is actually removed. Instead it refers to the shape of the drawers (30), i.e., they are generally circular with the appearance that a portion of their edge was removed to form a straight line edge (33).

In some preferred embodiments, a portion of the side wall of the drawer (30) positioned near a terminal end of the drawer lip (32) extends outward in a bump (34). This bump (34) is better able to be gripped by a human being and is intended to facilitate a human beings interaction with a drawer (30). In some embodiments, all drawers (30) on a single device have identical or nearly identical bumps (34).

In some preferred embodiments, the top surface of the drawer (30) has a spherical boss (28). The spherical boss (28) is capable of acting as the male portion of a hinge which allows for the rotation of the drawers (30) around a single axis. In some embodiments the spherical boss (28) is a half dome protrusion in the top surface. In some embodiments, the half dome protrusion has a diameter of from 1 mm-10 mm. In some embodiments the half dome protrusion has a circular lip (35) around its base. In some embodiments, the spherical boss (28) is positioned on the opposite or nearly the opposite side as the bump (34). In some embodiments, all the drawers (30) in a device have a spherical boss (28) positioned in the same place so that they are vertically aligned when the device is assembled. In the preferred embodiments, the spherical boss (28) of the top drawer (30) is aligned to fit into the spherical well (27) in the bottom surface of the drum top (18).

In the preferred embodiments, the side walls of the drawers (30) are generally smooth. In some embodiments a portion of the side wall or the entire side wall is textured to allow a human being to better grip it. In some embodiments, only the bump (34) is textured. In some embodiments, the height of the side walls of a drawer (30) is slightly elevated in the portions where there is a drawer lip (32) relative to the portions of the drawer (30) where there is not a drawer lip (32). The bottom side of the side walls of a drawer (30) is generally uniform in height and extends down to at least the depth of the depression (31) in the top surface of the drawer (30).

In the preferred embodiments, the bottom surface of the drawers (30) is largely determined by the depression (31) in the top surface of the drawers (30). The perimeter of the bottom surface of the drawer (30) is defined by the bottom of the side walls of the drawer (30). A circular protrusion (36) is created in the middle of the bottom surface by the depression (31) in the top surface. In some embodiments, the space between the circular protrusion (36) and the side walls is mostly empty.

In the preferred embodiments, the bottom surface has a spherical well (27). The spherical well (27) is capable of receiving the spherical boss (28) on the top surface. In some embodiments, the sides of the spherical wells (27) on the bottom surface of the drawer (30) extend the same length or nearly the same length as the side walls of the drawers (30). In the preferred embodiments, the spherical wells (27) on the bottom surface of the drawer (30) are positioned inline with the spherical bosses (28) on the top surfaces of the drawer (30). In some embodiments all the drawers (30) have a spherical well (27) on their bottom side. In some embodiments, the spherical bosses (28) on the top surfaces of the drawers (30) are capable of interfacing with the spherical wells (27) of the bottom surfaces of the drawers (30).

In some embodiments the bottom most drawer (30) has a spherical boss (28) on the top and bottom side. The spherical boss (28) on the bottom side is capable of interfacing with a spherical well (27) on the top surface of the drum bottom (20).

In the preferred embodiment, the drum bottom (20) is generally circular with a circumference that is the same or generally the same as the drum top (18). In some embodiments the drum top (18) and bottom have a radius that is greater than the radius of the drum wall (19). In some embodiments the difference between the radius of the drum top (18) and bottom and the drum wall (19) is 1 mm-10 mm.

In some embodiments the top surface of the drum bottom (20) has guiding groove (23) near its outer edges that extends around part of the top surface of the drum bottom (20). The guiding groove (23) is a small depression in the top surface of the drum bottom (20) capable of accepting the guiding rib (29) in the bottom surface of a drum wall (19).

In the preferred embodiment, the top surface of the drum bottom (20) is generally flat. In some embodiments the top surface of the drum bottom (20) has a spherical well (27) that is positioned to interface with the spherical boss (28) on the bottom surface of the bottom drawer (30). In some embodiments the top surface of the drum bottom (20) has a spherical boss (28) that is positioned to interface with the spherical well (27) on the bottom surface of the bottom drawer (30).

In the preferred embodiment, the bottom surface of the drum bottom (20) is generally flat. In some embodiments, the bottom surface of the drum bottom (20) has a circular shaped recess (26) in its center. In some embodiments, the bottom surface of the drum bottom (20) has at least three rubber feet (37) positioned to allow the device to rest stably on a flat surface. The rubber feet (37) no more than 10 mm in circumference positioned randomly or in a pattern with the proviso that the resulting positioning of the rubber feet (37) results in the device resting stably on a flat surface.

The edges of any of the above parts may be, for example, straight, curved, rounded, or beveled. The edges of the lid (1) and drum top (18) may, together, form a seamless edge that is, for example, straight, curved, rounded, or beveled. The edges of the lid (1) and drum top (18) may, together, form a series of edges that repeat or form a pattern.

The invention claimed is:

1. A cosmetics storage device comprising:

A. a drum assembly comprising:

i. a drum top, ii. a drum wall, and iii. a drum bottom;

B. a lid wherein the lid has a bottom surface with a mirror attached to said bottom surface, wherein the lid is positioned on top of a top surface of the drum top and integrated with the drum top and the drum wall via sonic welding of a lid hinge, lid hinge retainers, and lid hinge cavity; and C. at least two drawers nested in the drum assembly when in a closed position wherein the top surface of one drawer is attached to a bottom surface of the drum top through an interface between a spherical well and a spherical boss, a bottom surface of one drawer is attached to a top surface of the drum bottom through an interface between another spherical well and another spherical boss, top and bottom surfaces of the at least two drawers are attached to each other through an interface between another spherical well and another spherical boss, wherein the interface between each of the spherical bosses and spherical wells allows for rotational movement of each drawer independently along one axis and allows the drawers to rotate independently into and out of the drum assembly, and wherein each drawer has at least one depression capable of containing cosmetics products.

2. The cosmetics storage device of claim 1 wherein the lid is comprised of:

i. a lid dome, and ii. a lid base.

3. The cosmetics storage device of claim 2 wherein the lid dome is attached to the lid base by sonic welding of a lid dome rib and a lid base groove.

4. The cosmetics storage device of claim 1 wherein the lid hinge is a lid knuckle hinge.

5. The cosmetics storage device of claim 1 wherein the drum top and the drum bottom are attached to a top and bottom surface of the drum wall, respectively, through the sonic welding of guiding ribs on the top and bottom surfaces of the drum wall to guiding grooves on the bottom surface of the drum top and the top surface of the drum bottom.

6. The cosmetics storage device of claim 1 wherein one spherical boss or spherical well is positioned on the top surface of all drawers and one spherical boss or spherical well is positioned on the bottom surface of all drawers.

7. The cosmetics storage device of claim 1 wherein all spherical bosses and spherical wells of the device are vertically aligned.

8. The cosmetics storage device of claim 7 wherein the spherical bosses and spherical wells are positioned on the drawers so that the spherical bosses only interact with spherical wells and spherical wells only interact with spherical bosses.

9. The cosmetics storage device of claim 1 wherein the device has at least three drawers, and wherein the drawers that are not attached to the drum top or the drum bottom are attached to two other drawers through the interface between a spherical well and a spherical boss.

10. The cosmetics storage device of claim 2 wherein magnets in the lid base and the drum top are positioned to be vertically aligned with each other and are capable of securing the lid to the drum top via magnetic attraction.

11. The cosmetics storage device of claim of claim 1 wherein the lid hinge is unitary with the lid, the lid hinge retainers are unitary with the drum top, and the lid hinge cavity is inside the drum wall.

12. The cosmetics storage device of claim 11 wherein the lid hinge is positioned inside the lid hinge cavity and underneath the lid hinge retainers.

13. A cosmetics storage device comprising:

A. a drum assembly comprising:

i. a drum top, ii. a drum wall, and iii. a drum bottom;

B. a lid wherein the lid has a bottom surface with a mirror attached to said bottom surface, wherein the lid is positioned on top of a top surface of the drum top and integrated with the drum top and the drum wall via sonic welding of a lid hinge, lid hinge retainers, and lid hinge cavity, wherein the lid hinge is unitary with the lid, the lid hinge retainers are unitary with the drum top, and the lid hinge cavity is inside the drum wall, and wherein the lid hinge is positioned inside the lid hinge cavity and underneath the lid hinge retainers.

* * * * *